United States Patent [19]

Heili et al.

[11] Patent Number: 5,054,161

[45] Date of Patent: Oct. 8, 1991

[54] DISPENSER ACTUATOR HANDLE

[75] Inventors: Dean H. Heili, Manitowoc; James A. Diring, Green Bay, both of Wis.

[73] Assignee: James River Corporation, Oakland, Calif.

[21] Appl. No.: 582,742

[22] Filed: Sep. 14, 1990

[51] Int. Cl.[5] ..... A47B 95/00

[52] U.S. Cl. ..... 16/124; 16/110 R

[58] Field of Search ..... 16/110 A, 118, 119, 16/121, 124, 110 R

[56] References Cited

U.S. PATENT DOCUMENTS 878,881 2/1908 Hopkins ..... 16/110 R 1,436,287 11/1922 Penney ..... 16/124

FOREIGN PATENT DOCUMENTS 301570 12/1928 United Kingdom ..... 16/124

*Primary Examiner*—Robert L. Spruill
*Assistant Examiner*—Carmine Cuda
*Attorney, Agent, or Firm*—Thomas R. Lampe

[57] ABSTRACT

A dispenser actuator handle including a body member, a first protrusion projecting from the body member, a second protrusion projecting from the body member and disposed below the first protrusion, and a reinforcement rib extending between the protrusions.

7 Claims, 3 Drawing Sheets

DISPENSER ACTUATOR HANDLE

TECHNICAL FIELD

This invention relates to an actuator handle for attachment to a dispenser including a cabinet and dispenser mechanism for dispensing product from the cabinet. More particularly, the actuator handle of the present invention is for use with a wall-mounted dispenser and includes two protrusions which may be selectively manually engageable by a user of the dispenser, said protrusions being located at different heights.

BACKGROUND ART

Systems exist for retrofitting a previously installed in-the-wall folded paper towel cabinet by attaching to the housing thereof a roll paper towel dispensing cabinet. The roll paper towel dispenser cabinet must be attached to the housing at a predetermined location thereon; thus, the roll paper towel dispenser cabinet is disposed at a height above the floor predetermined by the fixed location of the previously installed housing.

Legal requirements exist in many jurisdictions relating to public washroom and rest room facilities, including regulations relating to placement of dispenser equipment so that it may be conveniently accessed by persons in wheel chairs. In retrofit situations of the type described above, the use as conventional dispenser actuator handles may not satisfy the requirements of such regulations.

DISCLOSURE OF INVENTION

The actuator handle of the present invention is so constructed as to provide ready access to a wall-mounted paper o towel dispenser by persons confined to a wheel chair. The actuator handle is also readily engageable by persons not so confined. The actuator handle may be utilized to satisfy regulated actuator handle height requirements. The handle may be retrofitted to existing cabinets or be affixed to a cabinet at the time of manufacture.

The actuator handle includes a body member having an inner face and an outer face, said inner face facing toward the cabinet with which it is employed and the outer face facing away from said cabinet.

A first protrusion projects outwardly from the body member outer face and has a first upwardly disposed surface manually engageable by an individual wishing to dispense product from the dispenser.

A second protrusion projects outwardly from the body member outer face and has a second upwardly disposed surface manually engageable by an individual wishing to dispense product from the dispenser. The second protrusion is disposed below the first protrusion and the second upwardly disposed surface is located a predetermined distance from the first upwardly disposed surface and in at least partial registry therewith.

A reinforcement rib extends between the first and second protrusions and projects outwardly from the body member outer face. The reinforcement rib not only provides structural stability and strength but also defines a cavity within which a portion of the dispenser mechanism is received when attaching the actuator handle to the dispenser.

Other features, advantages and objects of the present invention will become apparent with reference to the following detailed description and accompanying drawings.

BEST MODE FOR CARRYING OUT THE INVENTION

Figure 1:
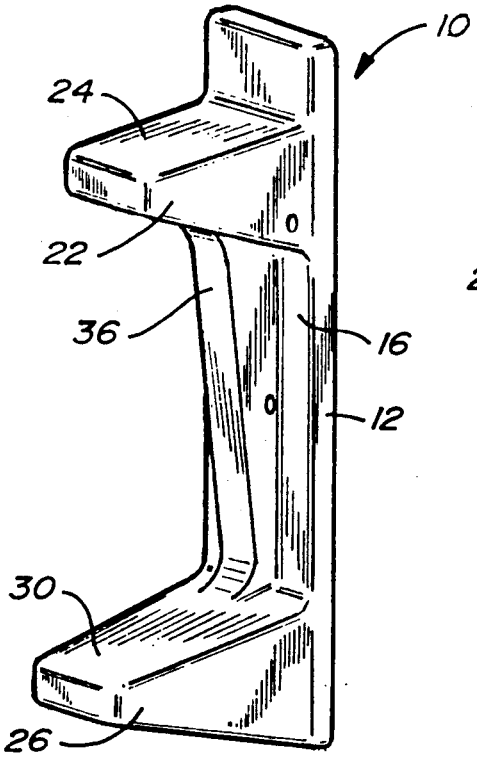
FIG. 1 is a perspective view of an actuator handle constructed in accordance with the teachings of the present invention.
Figure 6:
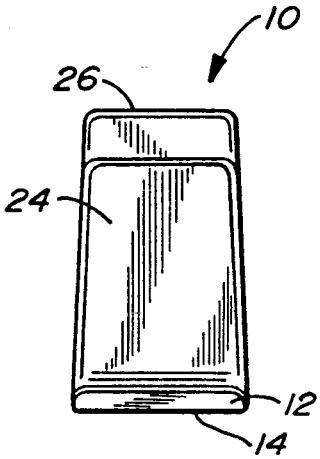
FIG. 6 is a top view of the handle.
Figure 5:
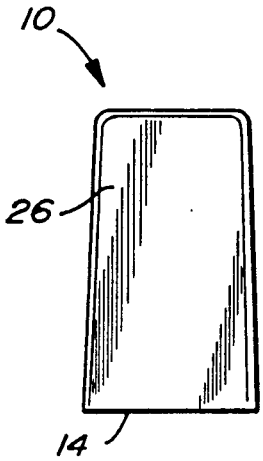
FIG. 5 is a bottom view of the handle.
Figure 2:
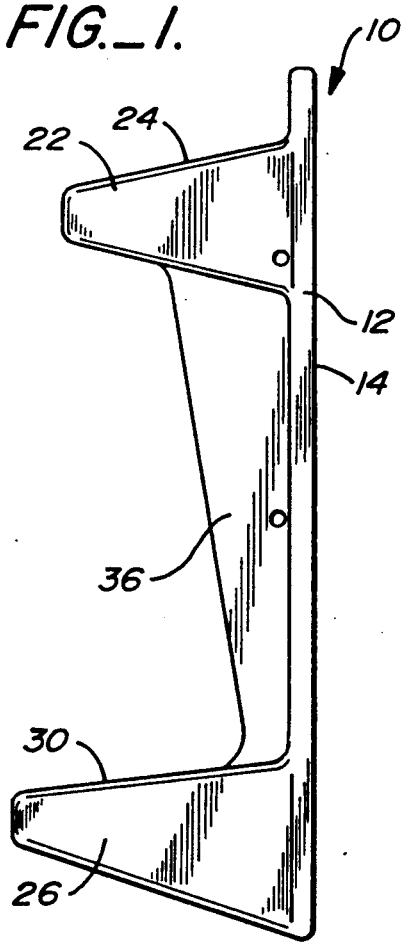
FIG. 2 is a side elevation view of the handle.
Figure 3:
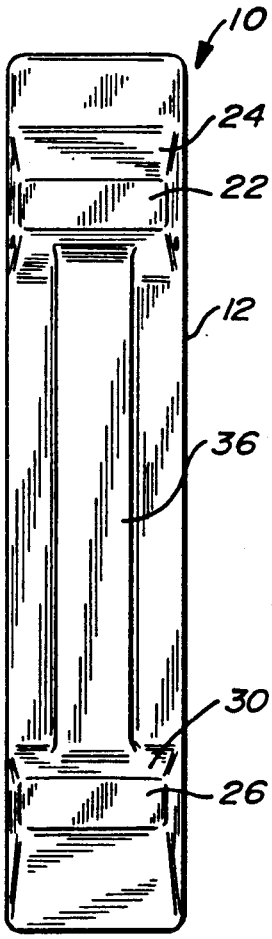
FIG. 3 is a front elevation view of the handle.
Figure 4:
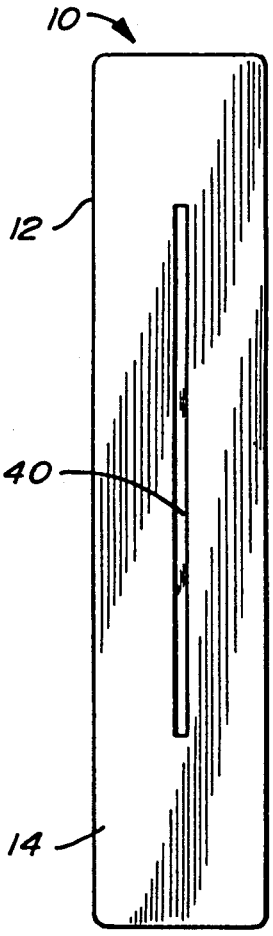
FIG. 4 is a rear elevation view of the handle.
Figure 7:
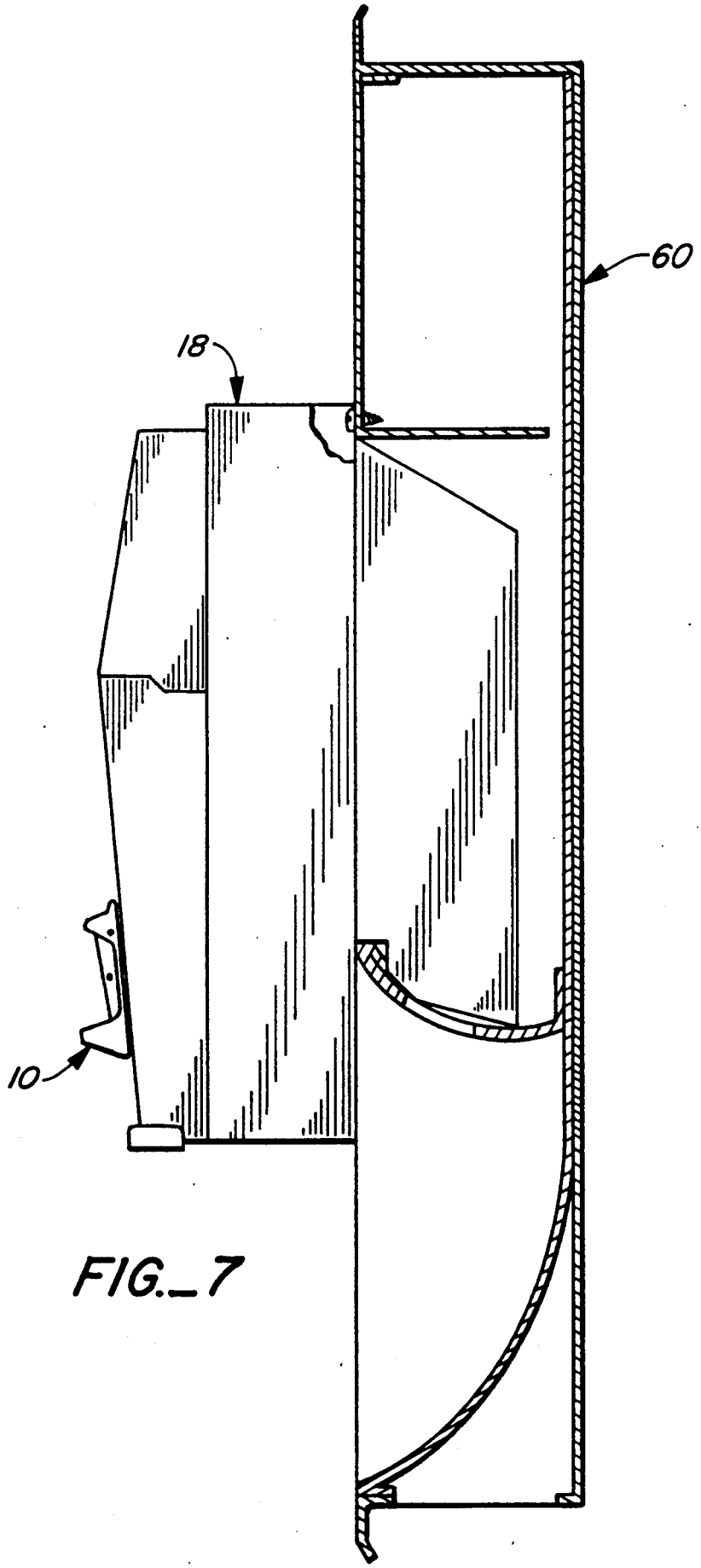
FIG. 7 is a partial sectional side view illustrating a roll paper towel cabinet having the handle connected thereto and mounted on an in-the-wall housing.

Referring now to the drawings, a preferred form of actuator handle constructed in accordance with the teachings of the present invention is identified generally by reference numeral 10. Actuator 10 is of integral molded plastic construction and includes a body member 12 having an inner face 14 and an outer face 16. Referring specifically to FIG. 7, it will be seen that when the handle 10 is attached to a roll paper towel dispenser 18 including a cabinet, the inner face 14 faces toward the cabinet and the outer face 16 faces away from the cabinet.

Actuator handle 10 also includes a first protrusion 22 projecting outwardly from the body member outer face. First protrusion 22 has a first upwardly disposed surface 24 which is manually engageable by an individual wishing to dispenser roll paper towel product from the dispenser 18.

A second protrusion 26 projects outwardly from body member outer face 16 and has a second upwardly disposed surface 30 manually engageable by an individual wishing to dispense product from the dispenser.

Second protrusion 26 is disposed below the first protrusion 22 and the second upwardly disposed surface 30 is located a predetermined distance from and below the first upwardly disposed surface and in at least partial registry therewith.

A reinforcement rib 3 extends between the first and second protrusions and projects outwardly from the body member outer face. As may clearly be seen, rib 36 tapers inwardly toward the body member outer face as the rib progresses in a downward direction from the first protrusion to the second protrusion. The reinforcement rib 36 has a major axis extending vertically at a mid width location of the handle.

Figure 8:
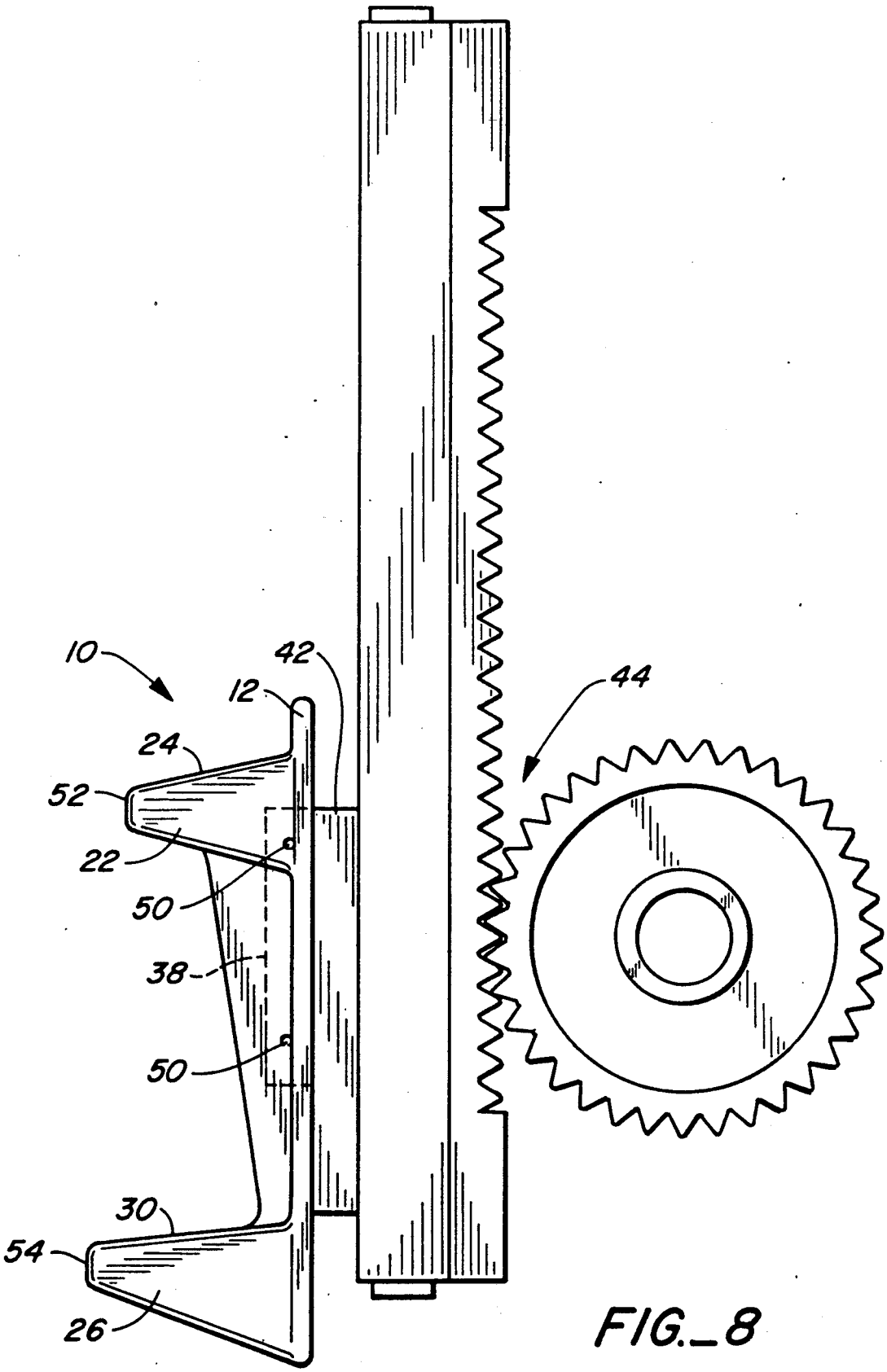
FIG. 8 is a side view illustrating the handle operably connected to a dispenser actuator mechanism employed in the roll paper towel dispenser cabinet.

A narrow aperture 40 is defined by the body member 12 at the inner face thereof. The reinforcement rib 36 defines a cavity 3 within the interior thereof in communication with the aperture. The side walls of the cavity are preferably straight and coextensive with the opposed sides of the aperture. The aperture and cavity are adapted to receive therein a portion of the dispenser mechanism. As shown in FIG. 8, such portion may, for example, be the reduced distal end of a flat plate 42 which is affixed to a rack and pinion arrangement 44 comprising part of the dispenser dispensing mechanism. The precise dispensing mechanism employed in the cabinet is a matter of choice and forms no part of the present invention. It is necessary only that some means such as flat plate 42 be provided to allow for operable connection between the actuator handle and the dispenser mechanism. It will be appreciated, of course, that in the vast majority of instances the dispenser mechanism will be located within the cabinet and that plate 42 projects through a suitable slot or orifice in the cabinet.

Securement means such as pins 50 are employed to secure the actuator handle to the plate 42. It is understood that the plate and handle have throughbores which are in alignment when the plate is positioned in cavity 38 through which the pins 50 pass during assembly.

Reinforcement rib 36 tapers inwardly toward the body member outer face as the reinforcement rib progresses in a downward direction from the first protrusion to the second protrusion. The first and second protrusions have distal ends 52, 54, respectively. Second protrusion 26 projects outwardly from the body member outer face a greater distance than the first protrusion 22 projects outwardly from the body member outer face. The distance between the body member outer face and the first protrusion distal end generally equals the distance between the reinforcement rib and the second protrusion distal end. This protrusion-rib interrelationship ensures that the second upwardly disposed surface 30 is of sufficient size to be readily accessed by a person wishing to actuate the dispenser. This is normally done by a finger and the distance between the first and second protrusions is of sufficient magnitude so as not to impede manual access to the second upwardly disposed surface 30. Of course, such distance should also be chosen to ensure that the locations of both the first and second protrusions satisfy legal and regulatory requirements.

Cavity 38 is oriented vertically along the major axis of the reinforcement rib 36 and closely approximates in width that of the plate 42. This arrangement imparts stability to the actuator handle. And of course, the rib adds to the overall strength of the handle, which during normal usage is subjected to considerable stress over a period of time. The rib accommodates compressive stresses when actuation is had by means of the first protrusion and tensile stresses which result when actuation is accomplished by means of second protrusion 26.

FIG. 7 shows the dispenser 18 mounted on an existing in-the-wall housing 60.

We claim:

1. An actuator handle for attachment to a dispenser including a cabinet and dispenser mechanism for dispensing product from said cabinet, comprising, in combination:

a body member having an inner face and an outer face, said inner face facing toward said cabinet and said outer face facing away from said cabinet when said actuator handle is attached thereto;

a first protrusion projecting outwardly from said body member outer face and having a first upwardly disposed surface manually engageable by an individual wishing to dispense product from said dispenser;

a second protrusion projecting outwardly from said body member outer face and having a second upwardly disposed surface manually engageable by an individual wishing to dispense product from said dispenser, said second protrusion being disposed below said first protrusion and said second upwardly disposed surface located a predetermined distance from said first upwardly disposed surface and in at least partial registry therewith; and a reinforcement rib extending between said first and second protrusions and projecting outwardly from said body member outer face, said body member defining an aperture at the inner face thereof and said reinforcement rib defining a cavity in communication with said aperture, said aperture and said cavity adapted to receive therein a portion of the dispenser mechanism.

2. The actuator handle according to claim 1 wherein said reinforcement rib tapers inwardly toward said body member outer face as said reinforcement rib progresses in a downward direction from said first protrusion to said second protrusion.

3. The actuator handle according to claim 1 of integral, molded construction.

4. An actuator handle for attachment to a dispenser including a cabinet and dispenser mechanism for dispensing product from said cabinet, comprising, in combination:

a body member having an inner face and an outer face, said inner face facing toward said cabinet and said outer face facing away from said cabinet when said actuator handle is attached thereto;

a first protrusion projecting outwardly from said body member outer face and having a first upwardly disposed surface manually engageable by an individual wishing to dispense product from said dispenser;

a second protrusion projecting outwardly from said body member outer face and having a second upwardly disposed surface manually engageable by an individual wishing to dispense product from said dispenser, said second protrusion being disposed below said first protrusion and said second upwardly disposed surface located a predetermined distance from said first upwardly disposed surface and in at least partial registry therewith; and a reinforcement rib extending between said first and second protrusions and projecting upwardly from said body member outer face, said first and second protrusions having distal ends, said second protrusion projecting outwardly from said body member outer face a greater distance than said first protrusion projects outwardly from said body member outer face, and the distance between the body member outer face and the first protrusion distal end generally equaling the distance between said reinforcement rib and the second protrusion distal end.

5. The actuator handle according to claim 1 additionally comprising securement means for securing said actuator handle to said dispenser mechanism portion when said dispenser mechanism portion is received within said aperture and said cavity.

6. The actuator handle according to claim 5 wherein said reinforcement rib has a major axis and wherein said aperture and said cavity are narrow and elongated, said cavity extending at least partially along the length of said reinforcement rib and oriented vertically along the major axis of said reinforcement rib.

7. The actuator handle according to claim 5 wherein said securement means comprises at least one connector element extending through aligned throughbores in said actuator handle and said dispenser mechanism portion, when said dispenser mechanism portion is received within said aperture and said cavity.

* * * * *